US012680745B2

(12) United States Patent
Jeong et al.

(10) Patent No.: US 12,680,745 B2
(45) Date of Patent: Jul. 14, 2026

(54) REFRIGERATOR

(71) Applicant: Samsung Electronics Co., Ltd., Suwon-si (KR)

(72) Inventors: Jin Jeong, Suwon-si (KR); Kwanyeol Lee, Suwon-si (KR); Bongsu Son, Suwon-si (KR); Hocheol Cho, Suwon-si (KR); Seokjun Son, Suwon-si (KR); Wonjae Yoon, Suwon-si (KR); Dongho Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 325 days.

(21) Appl. No.: 18/312,285

(22) Filed: May 4, 2023

(65) Prior Publication Data

US 2023/0272956 A1 Aug. 31, 2023

Related U.S. Application Data

(63) Continuation of application No. PCT/KR2022/000033, filed on Jan. 4, 2022.

(30) Foreign Application Priority Data

Feb. 26, 2021 (KR) ..... 10-2021-0026869
Jun. 9, 2021 (KR) ..... 10-2021-0074862

(51) Int. Cl.
*F25C 1/10* (2006.01)
*F25C 1/24* (2018.01)

(52) U.S. Cl.
CPC . *F25C 1/10* (2013.01); *F25C 1/24* (2013.01)

(58) Field of Classification Search
CPC ..... F25C 1/10; F25C 1/24; F25C 2305/022; F25C 2400/08; F25C 1/04; F25C 5/22; F25C 2400/06
See application file for complete search history.

(56) References Cited

U.S. PATENT DOCUMENTS 10,928,114 B2 2/2021 An et al.
11,105,547 B2 8/2021 Song et al.
(Continued)

FOREIGN PATENT DOCUMENTS

CN 103575010 A * 2/2014 ..... F25C 1/10
CN 108344219 A 7/2018
(Continued)

OTHER PUBLICATIONS

CN 103575010 A Translation (Year: 2014).*
(Continued)

*Primary Examiner* — Jerry-Daryl Fletcher
*Assistant Examiner* — Dario Antonio Deleon
(74) *Attorney, Agent, or Firm* — Jefferson IP Law, LLP

(57) ABSTRACT

A refrigerator is provided. The refrigerator includes a body including a storage compartment, and an icemaker provided inside the storage compartment, wherein the icemaker includes a first tray provided to form ice cubes having a first size, the first tray including a first rotating shaft, a second tray provided to form ice cubes having a second size, the second tray including a second rotating shaft, a first motor unit coupled to the front portion of the first rotating shaft of the first tray, a second motor unit coupled to the front portion of the second rotating shaft of the second tray, and an ice-making housing having a plurality of motor mounting frames at one surface thereof, and having a plurality of support frames at the other surface thereof so as to support the rear portions of the first and second rotating shafts respectively.

14 Claims, 15 Drawing Sheets

(56) References Cited

U.S. PATENT DOCUMENTS

| | | | | |
|---|---|---|---|---|
| 11,137,186 | B2 * | 10/2021 | Saito | F25C 5/185 |
| 2008/0163639 | A1 | 7/2008 | Hwang | |
| 2010/0163707 | A1 * | 7/2010 | Kim | F25C 1/04 249/120 |
| 2017/0307281 | A1 * | 10/2017 | Morgan et al. | F25C 5/22 |
| 2020/0103156 | A1 * | 4/2020 | Hayashi et al. | F25C 5/04 |
| 2021/0310714 | A1 * | 10/2021 | Olvera et al. | F25C 5/22 |
| 2021/0325099 | A1 * | 10/2021 | Cui et al. | F25C 1/24 |

FOREIGN PATENT DOCUMENTS

| | | | | | |
|---|---|---|---|---|---|
| CN | 109307392 | A | | 2/2019 | |
| CN | 109695979 | A | | 4/2019 | |
| DE | 10 2018 133 029 | A1 | | 6/2019 | |
| JP | 2003279221 | A | * | 10/2003 | F25C 2400/06 |
| JP | 3563671 | B2 | * | 9/2004 | F25D 17/06 |
| JP | 2006105421 | A | * | 4/2006 | F25C 1/24 |
| JP | 2013064546 | A | * | 4/2013 | F25C 1/04 |
| JP | 2013-234811 | A | | 11/2013 | |
| JP | 2015-031429 | A | | 2/2015 | |
| JP | 2019-113231 | A | | 7/2019 | |
| KR | 10-0269447 | B1 | | 10/2000 | |
| KR | 10-2008-0103350 | A | | 11/2008 | |
| KR | 20090079043 | A | * | 7/2009 | F25C 5/185 |
| KR | 20090125318 | A | * | 12/2009 | F25C 2400/06 |
| KR | 10-2018-0080021 | A | | 7/2018 | |
| KR | 10-2019-0087238 | A | | 7/2019 | |
| KR | 10-2022-0100388 | A | | 7/2022 | |

OTHER PUBLICATIONS

JP 2013064546 A Translation (Year: 2013).*
KR 20090079043 A Translation (Year: 2009).*
JP 2006105421 A Translation (Year: 2006).*
JP 3563671 B2 Translation (Year: 2004).*
JP 2003279221 A Translation (Year: 2003).*
KR 20090125318 A Translation (Year: 2009).*
Extended European Search Report dated Apr. 24, 2024; European Appln. No. 22759886.9-1201 / 4220052 PCT/KR2022000033.
International Search Report with Written Opinion and English translation dated Apr. 26, 2022; International Appln. No. PCT/KR2022/000033.

* cited by examiner

REFRIGERATOR

CROSS-REFERENCE TO RELATED APPLICATION(S)

This application is a continuation application, claiming priority under § 365(c), of an International application No. PCT/KR2022/000033, filed on Jan. 4, 2022, which is based on and claims the benefit of a Korean patent application number 10-2021-0026869, filed on Feb. 26, 2021, in the Korean Intellectual Property Office, and of a Korean patent application number 10-2021-0074862, filed on Jun. 9, 2021, in the Korean Intellectual Property Office, the disclosure of each of which is incorporated by reference herein in its entirety.

BACKGROUND

1. Field

The disclosure relates to a refrigerator. More particularly, the disclosure relates to a refrigerator having an icemaker with an improved structure.

2. Description of Related Art

A refrigerator is a home appliance which includes a main body having a storage compartment and a cold air supply apparatus provided to supply cold air to the storage compartment to keep food fresh.

In refrigerators, icemakers configured to make ice are provided sometimes. According to the related art, users directly supply water to the icemakers causing a reduction of user convenience.

In addition, the icemaker may include a plurality of ice-making units provided to generate ice having different sizes. In this case, a separate support member may be used to couple each of the ice-making units to an ice-making housing.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a refrigerator having an improved icemaker in which a plurality of ice-making units is directly coupled to an ice-making housing.

Another aspect of the disclosure is to provide a refrigerator in which a structure of an ice-making housing is improved to minimize frost in an icemaker.

Additional aspects will be set forth in part in the description which follows and, in part, will be apparent from the description, or may be learned by practice of the presented embodiments.

In accordance with an aspect of the disclosure, a refrigerator is provided. The refrigerator includes a main body including a storage compartment and an icemaker provided in the storage compartment, wherein the icemaker includes a first tray provided to make ice having a first size and including a first rotating shaft, a second tray provided to make ice having a second size and including a second rotating shaft, a first motor coupled to a front of the first rotating shaft of the first tray to rotate the first tray, a second motor coupled to a front of the second rotating shaft of the second tray to rotate the second tray, and an ice-making housing in which a plurality of motor mounting frames is formed on one surface so that the first motor and the second motor are fixed in the ice-making housing and a plurality of support frames is formed on another surface to support a rear of the first rotating shaft and a rear of the second rotating shaft.

The plurality of motor mounting frames may include a first motor mounting frame on which the first motor is mounted and a second motor mounting frame on which the second motor is mounted, wherein the first motor mounting frame may include a motor supporting surface provided in contact with an upper surface of the first motor and a seating rib extending forward from an inner rear of the motor supporting surface so that a part of the first motor is inserted into the seating rib.

The first motor may include a case and an insertion leg extending rearward from the case to be inserted into an insertion space formed by the seating rib of the first motor mounting frame.

The first motor mounting frame may include a front support extending downward from the motor supporting surface at a front of the seating rib to prevent forward movement of the first motor.

The plurality of support frames may include a first support frame provided to support the first tray and a second support frame provided to support the second tray, wherein the first support frame may include a shaft coupler in which a shaft coupling hole for accommodating a rear end portion of the first rotating shaft of the first tray is formed.

The ice-making housing may further include a cover plate in which a plurality of flowing holes is formed, an upper plate, and a pair of side plates.

The ice-making housing may include an open part formed in each of the pair of side plates so that cold air flows to an inside or an outside of the ice-making housing.

The upper plate of the ice-making housing may be disposed to be spaced apart from an inner case, and the ice-making housing may further include a plurality of air holes formed in the upper plate.

The ice-making housing may further include a pair of support legs extending upward and forward from the ice-making housing to be coupled to the inner case and an extension rib provided between the pair of support legs.

The extension rib may include an opening provided by cutting a part of the extension rib between the inner case and the upper plate so that cold air flows forward or rearward from the extension rib.

The opening may be provided at a higher level than the plurality of flowing holes.

The icemaker may further include a guide cover coupled to the plurality of support frames so that ice separated from the first tray and the second tray does not escape rearward.

The ice-making housing may include a tray partition extending downward from an upper surface of the ice-making housing to partition between the first tray and the second tray.

The plurality of motor mounting frames may be formed on an upper plate of the ice-making housing, and the plurality of support frames may be formed on a rear plate of the ice-making housing.

The ice-making housing may include a guide rib extending inward from an upper surface of the ice-making housing to guide a mounting position of the first tray, and a side rib extending from the guide rib in a side direction.

In accordance with another aspect of the disclosure, a refrigerator is provided. The refrigerator includes a main body including a storage compartment, a first ice-making unit provided to make ice having a first size, a second ice-making unit provided to make ice having a second size, and an ice-making housing coupled to one surface of the storage compartment so that the first ice-making unit and the second ice-making unit are mounted in the ice-making housing and including a cover plate forming a front surface, an upper plate, and a pair of side plates, wherein the ice-making housing includes an open part formed by cutting a part of each of the pair of side plates, a plurality of air holes formed in the upper plate, a plurality of flowing holes formed in the cover plate, a plurality of motor mounting frames which support the first ice-making unit and one side of the second ice-making unit and are formed to extend inward from an upper surface of the ice-making housing, and a plurality of support frames which support the second ice-making unit and the other side of the second ice-making unit and are formed on a rear surface of the ice-making housing.

The first ice-making unit may include a first motor configured to generate power and including an insertion leg extending rearward, and the plurality of motor mounting frames may include a first motor mounting frame having a seating rib forming a space in which the insertion leg of the first motor is accommodated.

The refrigerator may further include a guide cover coupled to the plurality of support frames to prevent ice separated from the first ice-making unit and the second ice-making unit from escaping rearward.

In accordance with another aspect of the disclosure, a refrigerator is provided. The refrigerator includes a main body including a storage compartment, a first ice-making unit including a first tray provided to make ice having a first size and a first motor configured to drive the first tray, a second ice-making unit including a second tray provided to make ice having a second size and a second motor configured to drive the second tray, and an ice-making housing in which the first ice-making unit and the second ice-making unit are mounted, wherein the ice-making housing includes a seating rib extending inward from an upper surface to form an insertion space so that a part of the first motor and a part of the second motor are accommodated.

The ice-making housing may further include shaft couplers having shaft coupling holes formed in a rear surface of the ice-making housing so that an end portion of the first tray and an end portion of the second tray pass through the shaft coupling holes.

Since a plurality of ice-making units are mounted on an inner surface of an ice-making housing without a separate support member, an icemaker having a simplified structure can be provided.

Since a structure of an ice-making housing is improved so that cold air efficiently flows in the ice-making housing, ice frosting phenomenon can be minimized.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
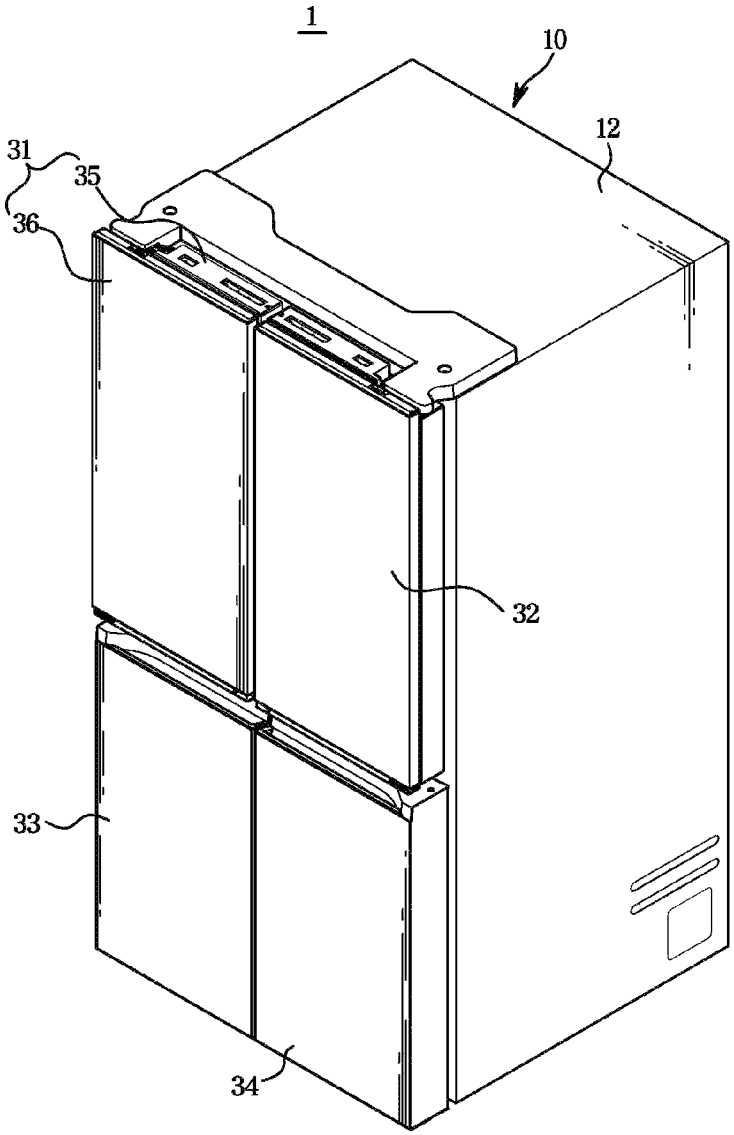
FIG. 1 is a perspective view illustrating a refrigerator according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In addition, the same reference numerals or symbols refer to parts or components which substantially perform the same function.

In addition, terms used in the disclosure are merely used to describe embodiments of the disclosure, and are not intended to limit and/or restrict the embodiments. In the disclosure, terms, such as "including," "having," and "comprising" are intended to indicate the presence of the features, numbers, steps, actions, components, parts, or combinations thereof described in the disclosure, and are not intended to preclude the possibility which one or more other features, numbers, steps, actions, components, parts, or combinations thereof may be present or added.

In addition, it should be understood that, although the terms "first," "second," and the like may be used in the disclosure to describe various components, these components should not be limited by these terms. These terms are only used to distinguish one component from another component. For example, a first component could be called a second component, and, similarly, a second component could be called a first component without departing from the scope of the disclosure. As used herein, the term "and/or" includes any one or combinations of the associated listed items.

FIG. 1 is a perspective view illustrating a refrigerator according to an embodiment of the disclosure.

Figure 2:
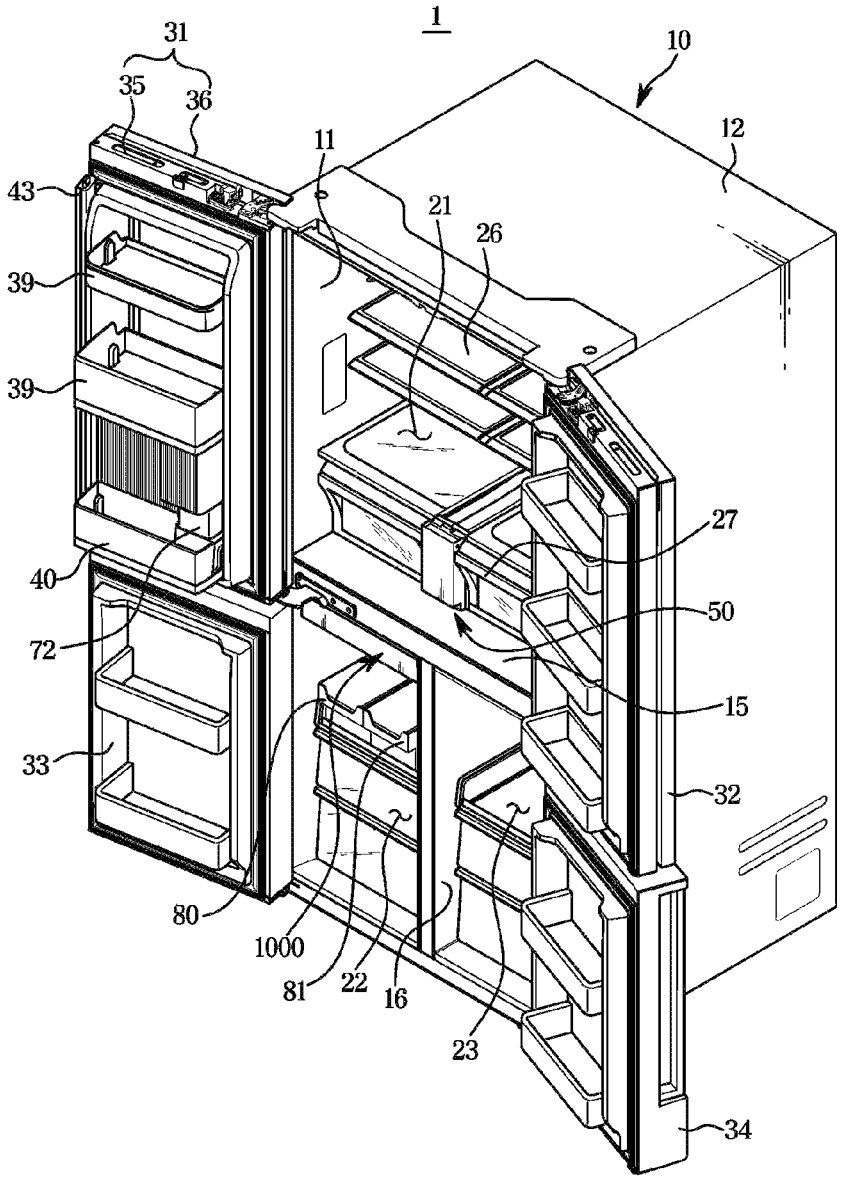
FIG. 2 is a view illustrating a state in which doors of a refrigerator of FIG. 1 are open according to an embodiment of the disclosure.
Figure 3:
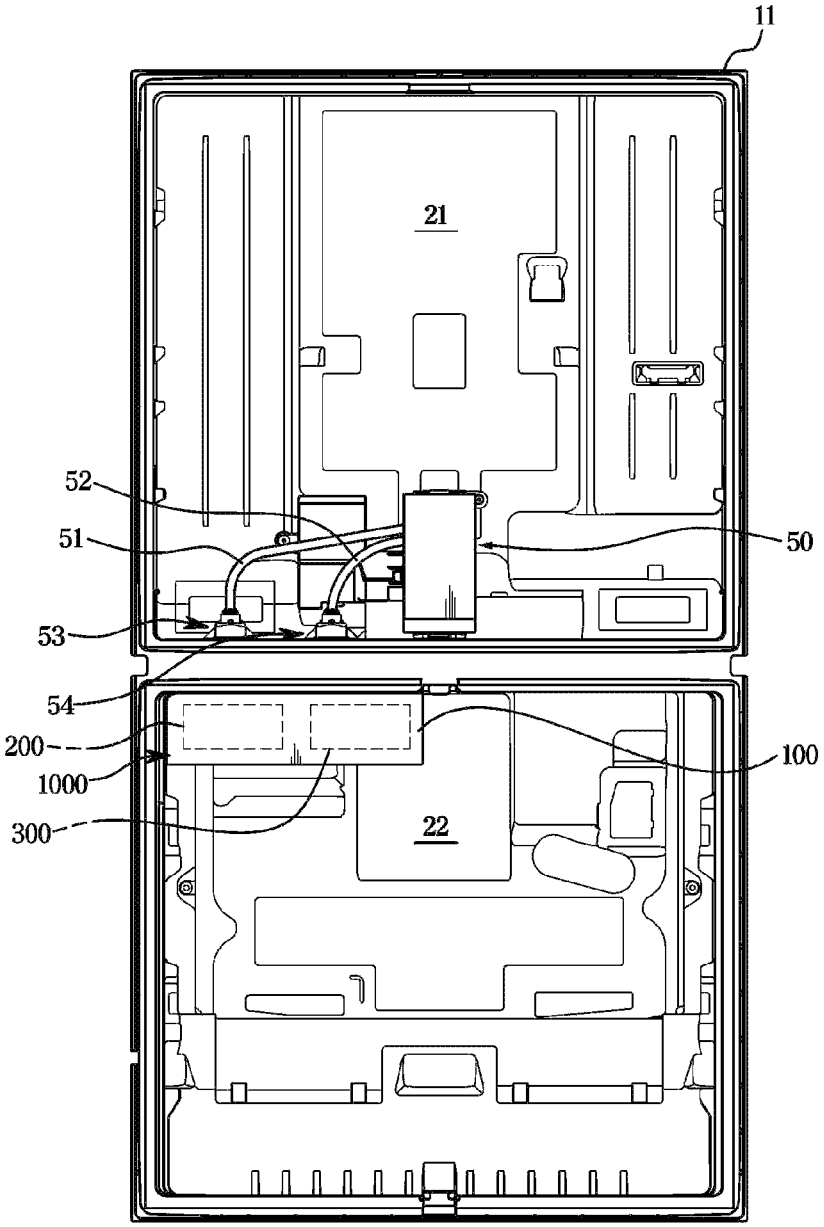
FIG. 3 is a schematic view illustrating a structure of an inner case, a water purifier and an icemaker which are disposed in an inner case, and a water supply passage in a refrigerator of FIG. 1 according to an embodiment of the disclosure.

FIG. 2 is a view illustrating a state in which doors of a refrigerator of FIG. 1 are open according to an embodiment of the disclosure. FIG. 3 is a schematic view illustrating a structure of an inner case, a water purifier and an icemaker which are disposed in the inner case, and a water supply passage in the refrigerator of FIG. 1 according to an embodiment of the disclosure.

Referring to FIGS. 1 and 2, a refrigerator 1 according to an embodiment of the disclosure includes a main body, a plurality of storage compartments 21, 22, and 23 provided in the main body, a plurality of doors 31, 32, 33, and 34 which open or close the plurality of storage compartments 21, 22, and 23, and a cold air supply apparatus (not shown) configured to supply cold air to the plurality of storage compartments 21, 22, and 23.

The main body may include an inner case 11 forming the storage compartments, an outer case 12 coupled to an outer side of the inner case 11 to form an exterior, and an insulator (not shown) provided between the inner case 11 and the outer case 12 to insulate the storage compartments.

The plurality of storage compartments 21, 22, and 23 may be divided by a horizontal partition 15 and a vertical partition 16. The plurality of storage compartments 21, 22, and 23 may be divided into a first storage compartment 21, which is an upper storage compartment, and a second storage compartment 22 and a third storage compartment 23, which are lower storage compartments, by the horizontal partition 15, and the lower storage compartments may be divided into the second storage compartment 22 and the third storage compartment 23 by the vertical partition 16.

The upper storage compartment which is the first storage compartment 21 may be used as a cold storage room. The lower storage compartments which are the second storage compartment 22 and the third storage compartment 23 may be used as freezer rooms. However, the use of dividing the plurality of storage compartments 21, 22, and 23 described above is only one example and is not limited thereto.

Hereinafter, the upper storage compartment which is the first storage compartment 21 is referred to as the cold storage room, and the lower storage compartments which are the second storage compartment 22 and the third storage compartment 23 are referred to as the freezer rooms.

In addition, unlike the embodiment of the disclosure, a refrigerator 1 may be a side by side (SBS) type refrigerator in which storage compartments are divided into a left storage compartment and a right storage compartment by a vertical partition 16, or a French door refrigerator (FDR) type refrigerator in which storage compartments are divided into an upper cold storage room and a lower freezer room by a horizontal partition 15.

A shelf 26 on which food is placed and a storage container 27 for storing food may be provided in the plurality of storage compartments 21, 22, and 23.

The cold air supply apparatus may generate cold air through a cooling circulation cycle of compressing, condensing, expanding, and evaporating a refrigerant and supply the generated cold air to the plurality of storage compartments 21, 22, and 23.

The cold storage room may be opened or closed by a pair of doors. The pair of doors may be rotatably coupled to the main body. The pair of doors may include a first door 31 and a second door 32.

A filler 43 which prevents cold air from leaking between the pair of doors when the pair of doors are closed may be provided in the first door 31 among the pair of doors.

The second storage compartment 22 which is a left freezer room may be opened or closed by a third door 33, and the third door 33 may be rotatably coupled to the main body.

The third storage compartment 23 which is a right freezer room may be opened or closed by a fourth door 34, and the fourth door 34 may be rotatably coupled to the main body.

The plurality of doors 31, 32, 33, and 34 may include door baskets 39 and 40 having door storage spaces for storing food. Gaskets in close contact with a front surface of the main body may be provided on rear surfaces of the plurality of doors 31, 32, 33, and 34 to seal the plurality of storage compartments 21, 22, and 23.

At least any one of the plurality of doors 31, 32, 33, and 34 may be formed as a double door including an inner door 35 and an outer door 36. As an example, the first door 31 may include the inner door 35 and the outer door 36.

The inner door 35 may be rotatably coupled to the main body using a hinge. The inner door 35 may have a door inner space. The door inner space may be formed in a central portion except for an edge portion of the inner door 35. The door inner space may be formed to extend between a front surface and the rear surface of the inner door 35. Accordingly, when the inner door 35 is closed, the door inner space may communicate with the cold storage room.

The door baskets 39 and 40 may be mounted in the door inner space.

A dispenser (not shown) may be provided in the door inner space. In addition, in the door inner space, a mounting space for a water container 72 in which the water container 72 may be mounted and an automatic water supply apparatus including a water level sensor (not shown) configured to detect a water level of the water container 72 when the water container 72 is mounted in the mounting space for the water container 72 may be provided.

When the water container 72 is installed in the mounting space for the water container 72, the water container 72 may be filled with a predetermined amount of water through the automatic water supply apparatus. For example, the automatic water supply apparatus may serve an auto-fill function.

Referring to FIGS. 2 and 3, a water purifier 50 may be disposed in the cold storage room. The water purifier 50 may be provided to purify and store water supplied from an external water supply source (not shown). The water purifier 50 may include a filter, a water tank, and the like.

The water purifier 50 may be disposed at one side of the cold storage room. For example, as illustrated in FIG. 2, the water purifier 50 may be disposed between a pair of storage containers 27 disposed side by side at the left and right of the water purifier 50 in the cold storage room. However, a position of the water purifier 50 is not limited thereto. The water purifier 50 may be disposed at an appropriate position in the cold storage room.

An icemaker 1000 may be disposed in the freezer room of the refrigerator 1. The icemaker 1000 may generate ice using cold air of the freezer room. The icemaker 1000 may be provided in the storage compartment.

According to the refrigerator 1 according to an embodiment of the disclosure, the icemaker 1000 may be disposed in the second storage compartment 22 which is the left freezer room. More specifically, the icemaker 1000 may be disposed at an upper left end of the left freezer room. However, the disclosure is not limited thereto, and the icemaker 1000 may be disposed in the third storage compartment 23 which is the right freezer room.

According to an embodiment of the disclosure, the refrigerator 1 may include a pair of ice-making units. The pair of ice-making units may include a first ice-making unit 200 and a second ice-making unit 300. The first ice-making unit 200 and the second ice-making unit 300 may be disposed side by side in a left-right direction.

The first ice-making unit 200 and the second ice-making unit 300 may be configured to make different types of ice. Accordingly, a user may select a desired type of ice from any one of the first ice-making unit 200 and the second ice-making unit 300.

In addition, since the plurality of ice-making units are provided, an amount of ice made by the icemaker 1000 may increase. The user may take out a relatively sufficient amount of ice compared to a refrigerator 1 having one ice-making unit.

The refrigerator 1 may include a plurality of ice buckets 80 and 81. As the icemaker 1000 of the refrigerator 1 according to an embodiment of the disclosure has the plurality of ice-making units 200 and 300, the plurality of ice buckets 80 and 81 may be provided to store ice made in different shapes.

The refrigerator 1 may include a first connection hose 51 which receives water from the external water supply source through the water purifier 50 and supplies the water to the first ice-making unit 200. In addition, the refrigerator 1 may include a second connection hose 52 through which water passing through the water purifier 50 is supplied to the second ice-making unit 300.

Accordingly, the water passing through the water purifier 50 may be supplied to the first ice-making unit 200 through the first connection hose 51 and a first water supply apparatus 53 and to the second ice-making unit 300 through the second connection hose 52 and a second water supply apparatus 54. The first water supply apparatus 53 and the second water supply apparatus 54 may pass through the inner case 11 and be provided on an ice-making housing 100.

The first water supply apparatus 53 and the second water supply apparatus 54 may include a first water supply pipe and a second water supply pipe which guide water of the first connection hose 51 and the second connection hose 52 to the first ice-making unit 200 and the second ice-making unit 300, respectively. Each of the first water supply pipe and the second water supply pipe may be formed of a metal material, and as an example, may be formed of an aluminum material. An insulating part (not shown) may be provided to cover at least a part of each of the first water supply pipe and the second water supply pipe. In addition, although not specifically illustrated in the drawings, each of the first water supply pipe and the second water supply pipe may include a heater (not shown). Accordingly, water in the first water supply pipe and the second water supply pipe may be prevented from freezing and blocking inlets and outlets of the first water supply pipe and the second water supply pipe.

Figure 4:
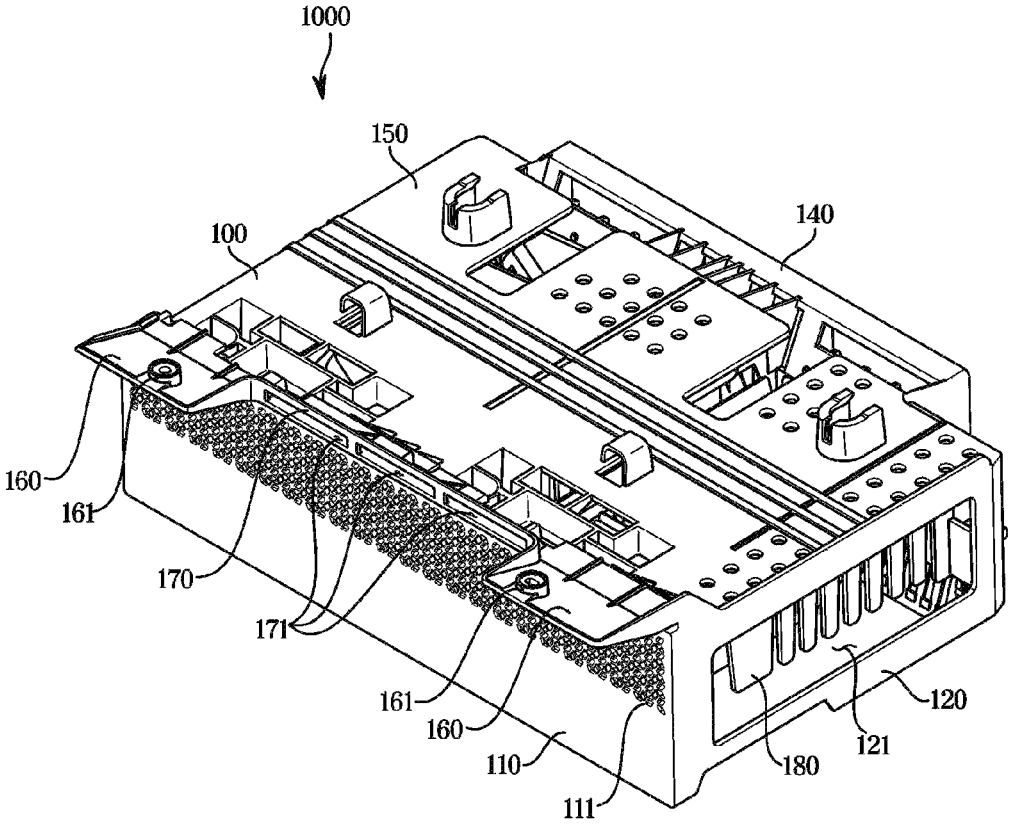
FIG. 4 is a view illustrating an icemaker of FIG. 1 according to an embodiment of the disclosure.

FIG. 4 is a view illustrating an icemaker of FIG. 1 according to an embodiment of the disclosure.

Figure 5:
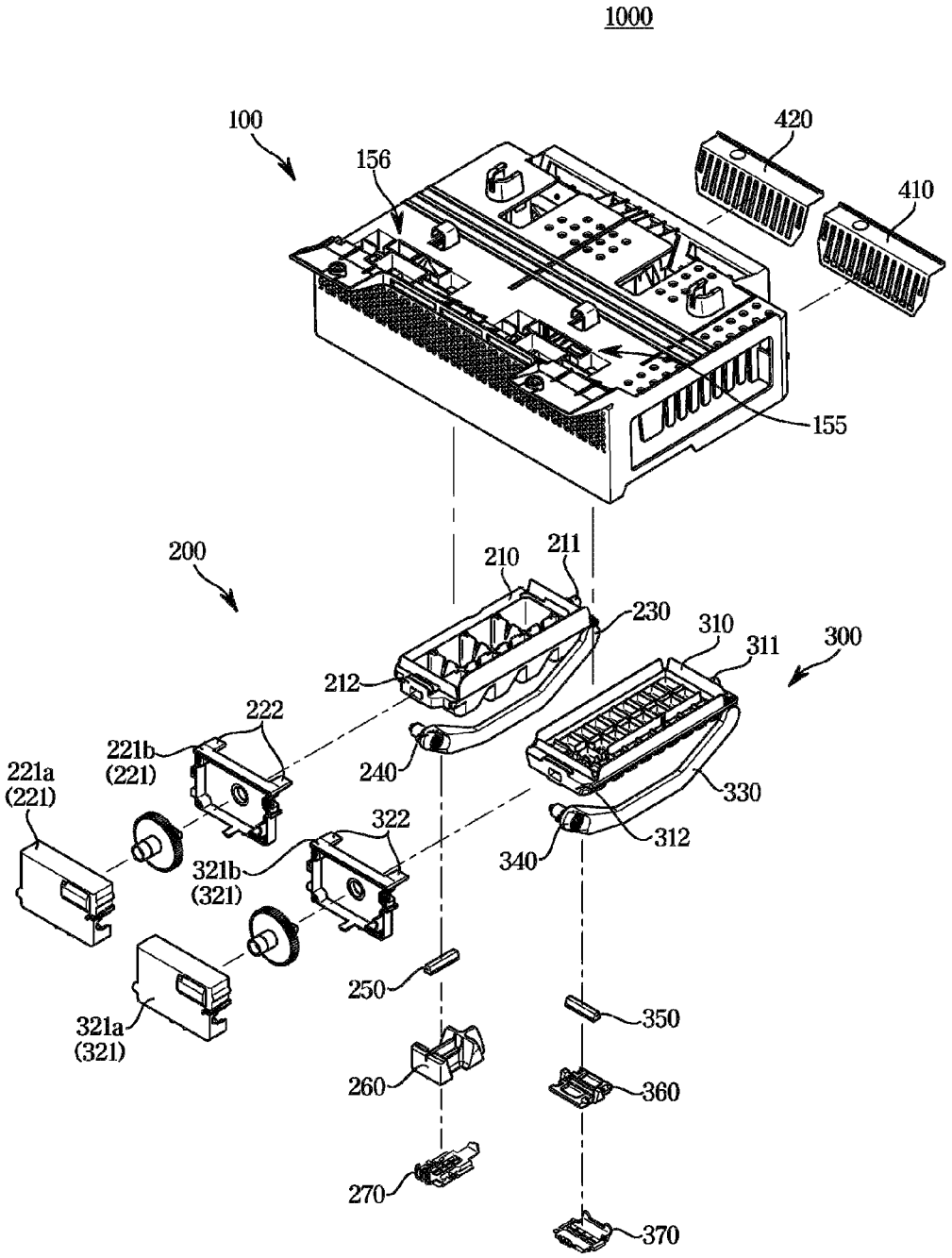
FIG. 5 is an exploded view illustrating an icemaker of FIG. 4 according to an embodiment of the disclosure.

FIG. 5 is an exploded view illustrating an icemaker of FIG. 4 according to an embodiment of the disclosure.

Referring to FIGS. 4 and 5, the icemaker 1000 may include the first ice-making unit 200, the second ice-making unit 300, and an ice-making housing 100 in which the first ice-making unit 200 and the second ice-making unit 300 are mounted.

The first ice-making unit 200 may include a first tray 210.

The first tray 210 may be provided to make ice having a first size. More specifically, the first tray 210 may include one of more ice-making cells which store water for making ice. Each of the ice-making cells may be partitioned by a partition.

The first tray 210 may include a first rotating shaft 211. The first rotating shaft 211 may be provided to protrude outward from the first tray 210 from a rear side of the first tray 210.

The first tray 210 may include a first motor coupler 212. The first motor coupler 212 may be formed at a front side of the first tray 210. The first motor coupler 212 may be provided so that a first transmission part 223 (see FIG. 9) of a first motor 220, which will be described below, is inserted into the first motor coupler 212.

The first ice-making unit 200 may include the first motor 220.

The first motor 220 may be provided to be coupled to a front side of the first rotating shaft 211 of the first tray 210 to rotate the first tray 210.

The first motor 220 may include a first case 221 and a first insertion leg 222. A motor (not shown) configured to generate power and a power transmission gear may be provided between the first case 221 and the first insertion leg 222.

A first front case 221*a* and a first rear case 221*b* may be coupled to form the first case 221 so that an accommodation space is formed in the first case 221. However, the disclosure is not limited thereto, and the first case 221 may be integrally formed.

The first insertion leg 222 may be provided to extend rearward from the first case 221. The first insertion leg 222 may be provided as a pair of first insertion legs 222. The first insertion legs 222 may be provided on an upper portion of the first case 221. The first insertion legs 222 may be provided so that the first motor 220 is supported by a first motor mounting frame 155 of the ice-making housing 100 which will be described below. In addition, the number of first insertion legs 222 is not limited thereto. A detailed coupling relationship between the first insertion legs 222 and the first motor mounting frame 155 will be described below.

The first ice-making unit 200 may include a first full ice detection lever 230 and a first lever mounting part 240.

The first full ice detection lever 230 may be provided to detect whether the first ice bucket 80 disposed under the icemaker 1000 is fully filled with ice. The first full ice detection lever 230 may be coupled to the first case 221 using the first lever mounting part 240. Specifically, the first full ice detection lever 230 may be coupled to a side portion of the first case 221.

The first full ice detection lever 230 may be rotatably coupled to the first case 221. More specifically, the first full ice detection lever 230 may be provided to be rotated in a vertical direction with respect of the first lever mounting part 240 coupled to the first case 221.

The first lever mounting part 240 may be provided to be coupled to a side portion of the first case 221 to connect the first full ice detection lever 230 and the first case 221. However, the disclosure is not limited thereto, and the first lever mounting part 240 may be integrally formed with the first case 221.

When the first full ice detection lever 230 recognizes that ice fully fills the inside of the first ice bucket 80, a controller (not shown) controls water to be no longer supplied to the icemaker 1000. Accordingly, ice can be prevented from being collected more than necessary in the ice bucket.

The first ice-making unit 200 may include a first sensor 250, a first insulator 260, and a first sensor case 270. The first sensor 250 may be mounted on a lower portion of the first tray 210 of the first ice-making unit 200. The first sensor 250 may be a temperature sensor provided to detect a temperature of the first tray 210.

When the first sensor 250 detects that a temperature of the first tray 210 is less than or equal to a predetermined temperature, the controller (not shown) may recognize that ice is completely made in the first tray 210. Accordingly, the controller (not shown) may rotate the first tray 210 by driving the first motor 220. Accordingly, the ice made in the first tray 210 may be collected in the first ice bucket 80 disposed under the first tray 210.

The first insulator 260 may be provided to accommodate the first sensor 250. The first sensor case 270 may be provided to accommodate the first insulator 260. An electric wire is connected through the first sensor case 270 to supply power to the sensor and transmit information to the controller (not shown).

The second ice-making unit 300 may also have a structure similar to that of the first ice-making unit 200.

The second ice-making unit 300 may include a second tray 310.

The second tray 310 may be provided to make ice having a second size. More specifically, the second tray 310 may include one or more ice-making cells which store water for making ice. Each of the ice-making cells may be partitioned by a partition.

The second tray 310 may include a second rotating shaft 311. The second rotating shaft 311 may be provided to protrude outward from the second tray 310 from a rear side of the second tray 310.

The second tray 310 may include a second motor coupler 312. The second motor coupler 312 may be formed at a front side of the second tray 310. The second motor coupler 312 may be provided so that a second transmission part 323 (see FIG. 11) of a second motor 320, which will be described below, is inserted into the second motor coupler 312.

The second ice-making unit 300 may include the second motor 320.

The second motor 320 may be provided to be coupled to a front side of the second rotating shaft 311 of the second tray 310 to rotate the second tray 310.

The second motor 320 may include a second case 321 and a second insertion leg 322. A motor (not shown) configured to generate power and a power transmission gear may be provided between the second case 321 and the second insertion leg 322.

A second front case 321*a* and a second rear case 321*b* may be coupled to form the second case 321 so that an accommodation space is formed in the second case 321. However, the disclosure is not limited thereto, and the second case 321 may be integrally formed.

The second insertion leg 322 may be provided to extend rearward from the second case 321. The second insertion leg 322 may be provided as a pair of second insertion legs 322. The second insertion legs 322 may be provided on an upper portion of the second case 321. The second insertion legs 322 may be provided so that the second motor 320 is supported by a second motor mounting frame 156 of the ice-making housing 100 which will be described below. In addition, the number of second insertion legs 322 is not limited thereto. A detailed coupling relationship between the second insertion legs 322 and the second motor mounting frame 156 will be described below.

The second ice-making unit 300 may include a second full ice detection lever 330 and a second lever mounting part 340.

The second full ice detection lever 330 may be provided to detect whether the second ice bucket 81 disposed under the icemaker 1000 is fully filled with ice. The second full ice detection lever 330 may be coupled to the second case 321 using the second lever mounting part 340. Specifically, the second full ice detection lever 330 may be coupled to a side portion of the second case 321.

The second full ice detection lever 330 may be rotatably coupled to the second case 321. More specifically, the second full ice detection lever 330 may be provided to be rotated in the vertical direction with respect to the second lever mounting part 340 coupled to the second case 321.

The second lever mounting part 340 may be provided to be coupled to a side portion of the second case 321 to connect the second full ice detection lever 330 and the second case 321. However, the disclosure is not limited thereto, and the second lever mounting part 340 may be integrally formed with the second case 321.

When the second full ice detection lever 330 recognizes that ice fully fills the inside of the second ice bucket 81, the controller (not shown) controls water to be no longer supplied to the icemaker 1000. Accordingly, ice can be prevented from being collected more than necessary in the ice bucket.

The second ice-making unit 300 may include a second sensor 350, a second insulator 360, and a second sensor case 370. The second sensor 350 may be mounted on a lower portion of the second tray 310 of the second ice-making unit 300. The second sensor 350 may be a temperature sensor provided to detect a temperature of the second tray 310.

When the second sensor 350 detects that a temperature of the second tray 310 is equal to or less than a predetermined temperature, the controller (not shown) may recognize that ice is completely made in the second tray 310. Accordingly, the controller (not shown) may rotate the second tray 310 by driving the second motor 320. Accordingly, the ice made in the second tray 310 may be collected in the second ice bucket 81 disposed under the second tray 310.

The second insulator 360 may be provided to accommodate the second sensor 350. The second sensor case 370 may be provided to accommodate the second insulator 360. An electric wire may be connected through the second sensor case 370 to supply power to the sensor and transmit information to the controller (not shown).

The ice having the first size made by the first ice-making unit 200 and the ice having the second size made by the second ice-making unit 300 may have different sizes.

The icemaker 1000 may include a first guide cover 410 and a second guide cover 420.

The first guide cover 410 may be mounted on a rear side of the ice-making housing 100 to be disposed behind the first ice-making unit 200. The first guide cover 410 may be provided to collect ice into the first ice bucket 80 when the first motor 220 rotates and the ice is separated from the first tray 210. In other words, the first guide cover 410 may be provided to prevent the ice from escaping rearward from the first ice bucket 80. The first guide cover 410 may be formed by bending a substantially rectangular flat plate.

The second guide cover 420 may be mounted on the rear side of the ice-making housing 100 to be disposed behind the second ice-making unit 300. The second guide cover 420 may be provided to collect ice into the second ice bucket 81 when the second motor 320 rotates and the ice is separated from the second tray 310. In other words, the second guide cover 420 may be provided to prevent ice from escaping rearward from the second ice bucket 81. The second guide cover 420 may be formed by bending a substantially rectangular flat plate.

Detailed structures of the first guide cover 410 and the second guide cover 420 and a coupling relationship between the first guide cover 410 and the second guide cover 420 and the ice-making housing 100 will be described below.

The ice-making housing 100 may be provided to accommodate the first ice-making unit 200 and the second ice-making unit 300. The ice-making housing 100 may include the first motor mounting frame 155 on which the first motor 220 is mounted and the second motor mounting frame 156 on which the second motor 320 is mounted.

The ice-making housing 100 may be provided in substantially a box shape of which one surface is open. The ice-making housing 100 may include a cover plate 110 forming a front surface of the ice-making housing 100, a pair of side plates extending from side portions of the cover plate 110 to form side surfaces, a rear plate 140 which forms a rear surface, and an upper plate 150 which forms an upper surface.

A plurality of flowing holes 111 may be formed in the cover plate 110. The cover plate 110 is a component exposed to the user when the third door 33 of the refrigerator 1 is opened. Accordingly, the plurality of flowing holes 111 may be formed in an upper portion of the cover plate 110 to have certain aesthetics.

In addition, the ice-making housing 100 may include a pair of support legs 160 extending upward and forward from the upper plate 150. The ice-making housing 100 may include an extension rib 170 provided between the pair of support legs 160.

The pair of support legs 160 may be provided to be coupled to the inner case 11. Each of the pair of support legs 160 may include an inner case coupler 161. The inner case 11 and the ice-making housing 100 may be coupled using the inner case coupler 161. Accordingly, the ice-making housing 100 may be fixed into the freezer room.

The extension rib 170 may include an opening 171 provided by cutting a part of the extension rib 170. Cold air remaining in a space between the upper plate 150 of the ice-making housing 100 and the inner case 11 may flow to the inside or the outside of the extension rib 170 through the opening 171. In other words, the opening 171 of the extension rib 170 may be provided between the inner case 11 and the upper plate 150. Although, it is illustrated in FIG. 4 that three openings 171 are formed, the number of openings 171 is not limited thereto.

The pair of support legs 160 and the extension rib 170 may be provided on the cover plate 110. The upper plate 150 of the ice-making housing 100 may be disposed to be spaced a predetermined distance from the inner case 11. Accordingly, the pair of support legs 160 and the extension rib 170 may be provided between the upper plate 150 of the ice-making housing 100 and the inner case 11.

The ice-making housing 100 may include a first open part 121 formed in a first side plate 120. The first open part 121 may be provided so that cold air flows to the outside and the inside of the ice-making housing 100. The ice-making housing 100 may include a second side plate 130 (see FIG. 6) formed at an opposite side. The ice-making housing 100 may include a second open part 131 formed in the second side plate 130. The second open part 131 may be provided so that cold air flows to the outside and the inside of the ice-making housing 100.

The first open part 121 and the second open part 131 may be formed by cutting a part of the first side plate 120 and a part of the second side plate 130 of the ice-making housing 100.

Cool air may easily flow into the ice-making housing 100 through the first open part 121 and the second open part 131 to supply sufficient cool air to make ice.

At the same time, when the cold air flowing into the ice-making housing 100 remains in the ice-making housing 100, a phenomenon in which ice is frosted due to supercooling may occur. When the ice frosting phenomenon occurs, frost may be generated in the icemaker 1000. In addition, ice may not be easily separated from the icemaker 1000.

In order to minimize such a phenomenon, a plurality of flowing holes 111 are formed in the cover plate 110 of the ice-making housing 100 so that the cold air remaining in the ice-making housing 100 flows forward to the outside of the ice-making housing 100. In addition, a plurality of air holes 154 (see FIG. 15) are formed in the upper plate 150 of the ice-making housing 100 so that the cold air remaining in the ice-making housing 100 may flow upward to the outside of the ice-making housing 100. In addition, cold air remaining between the inner case 11 and the upper plate 150 of the ice-making housing 100 may flow forward to the outside of the ice-making housing 100 through the openings 171 of the extension rib 170.

Figure 6:
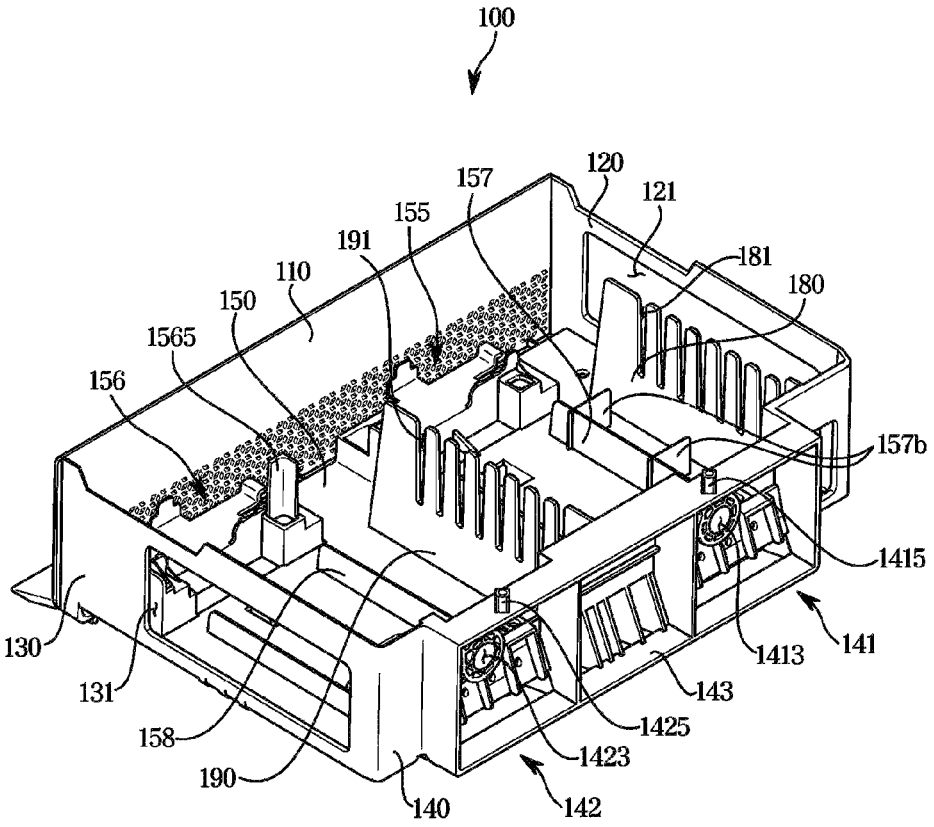
FIG. 6 is a view illustrating an ice-making housing of FIG. 4 turned upside down according to an embodiment of the disclosure.

FIG. 6 is a view illustrating an ice-making housing of FIG. 4 turned upside down according to an embodiment of the disclosure.

Figure 7:
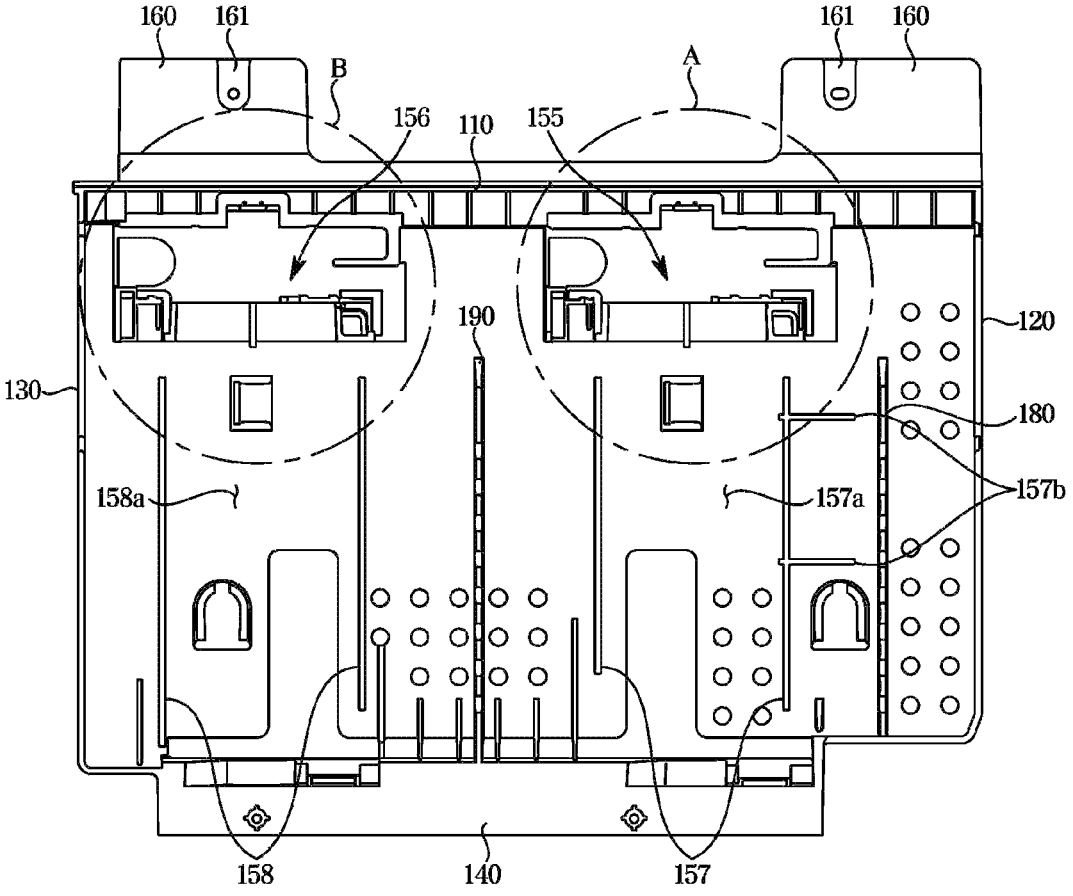
FIG. 7 is a front view illustrating a lower surface of an ice-making housing of FIG. 6 according to an embodiment of the disclosure.

FIG. 7 is a front view illustrating a lower surface of an ice-making housing of FIG. 6 according to an embodiment of the disclosure.

Figure 8:
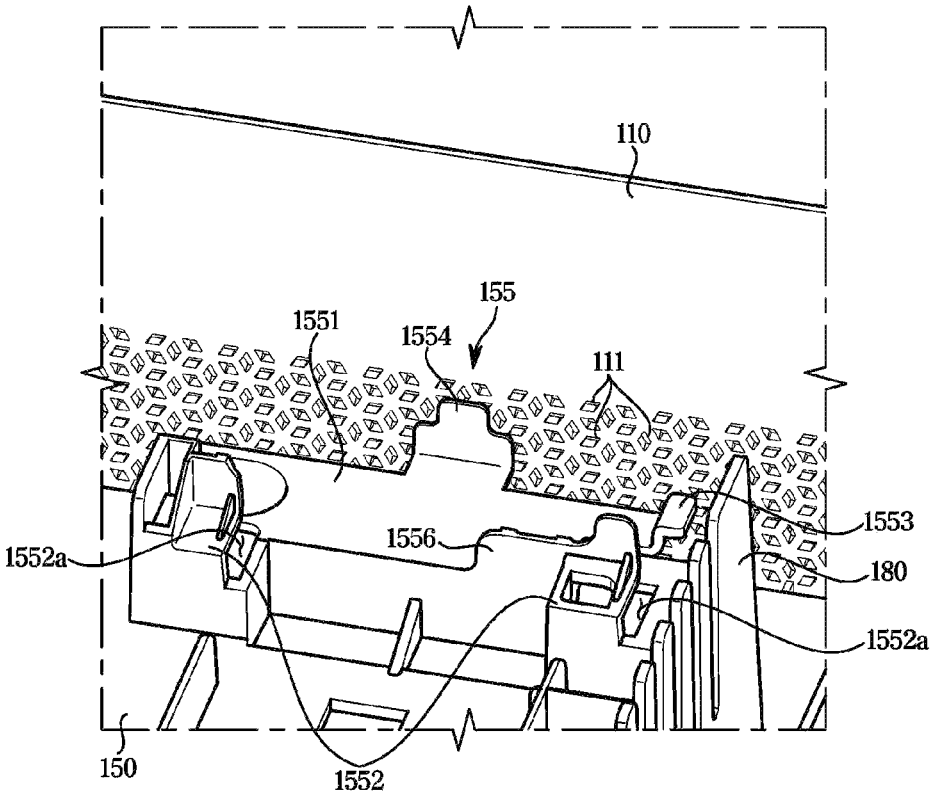
FIG. 8 is an enlarged view illustrating portion A of FIG. 7 according to an embodiment of the disclosure.

FIG. 8 is an enlarged view illustrating portion A of FIG. 7 according to an embodiment of the disclosure.

Figure 9:
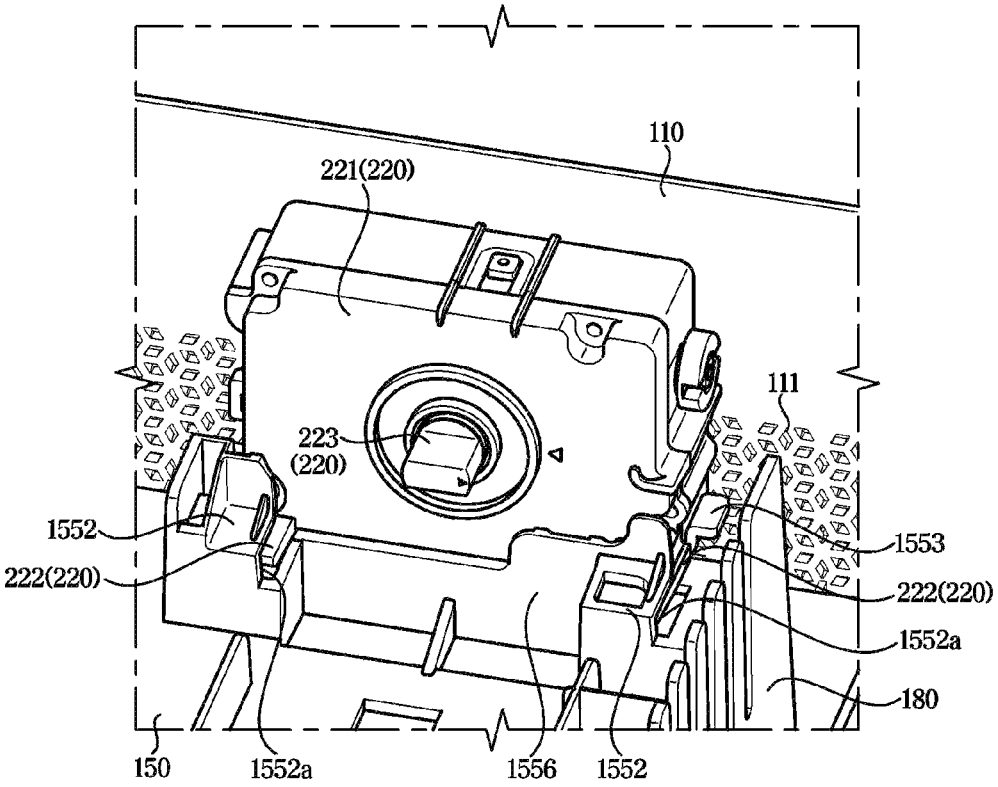
FIG. 9 is a view illustrating a state in which a first motor is mounted in an ice-making housing of FIG. 8 according to an embodiment of the disclosure.

FIG. 9 is a view illustrating a state in which a first motor is mounted in an ice-making housing of FIG. 8 according to an embodiment of the disclosure.

Figure 10:
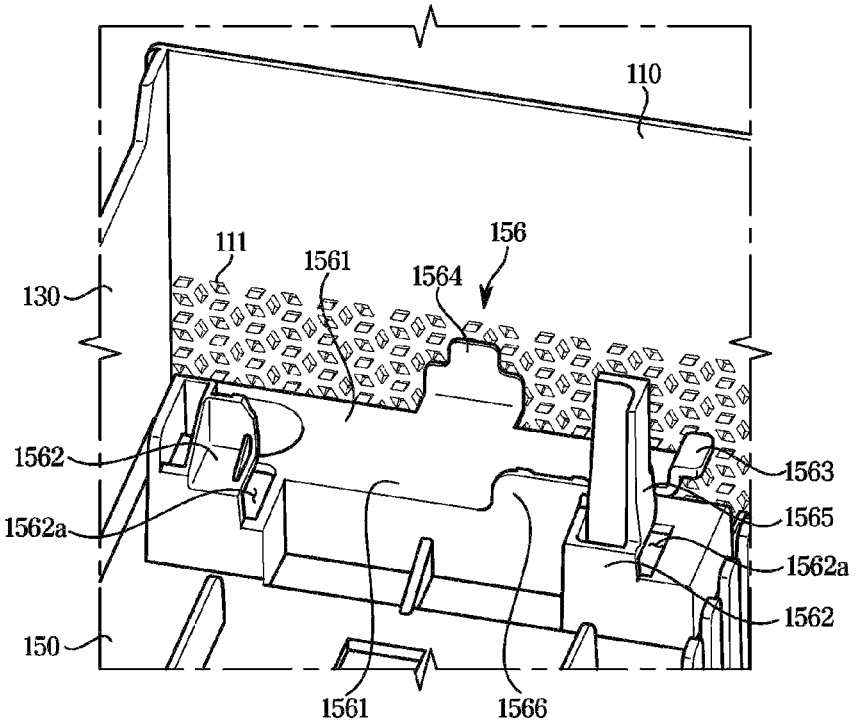
FIG. 10 is an enlarged view illustrating portion B of FIG. 7 according to an embodiment of the disclosure.

FIG. 10 is an enlarged view illustrating portion B of FIG. 7 according to an embodiment of the disclosure.

Figure 11:
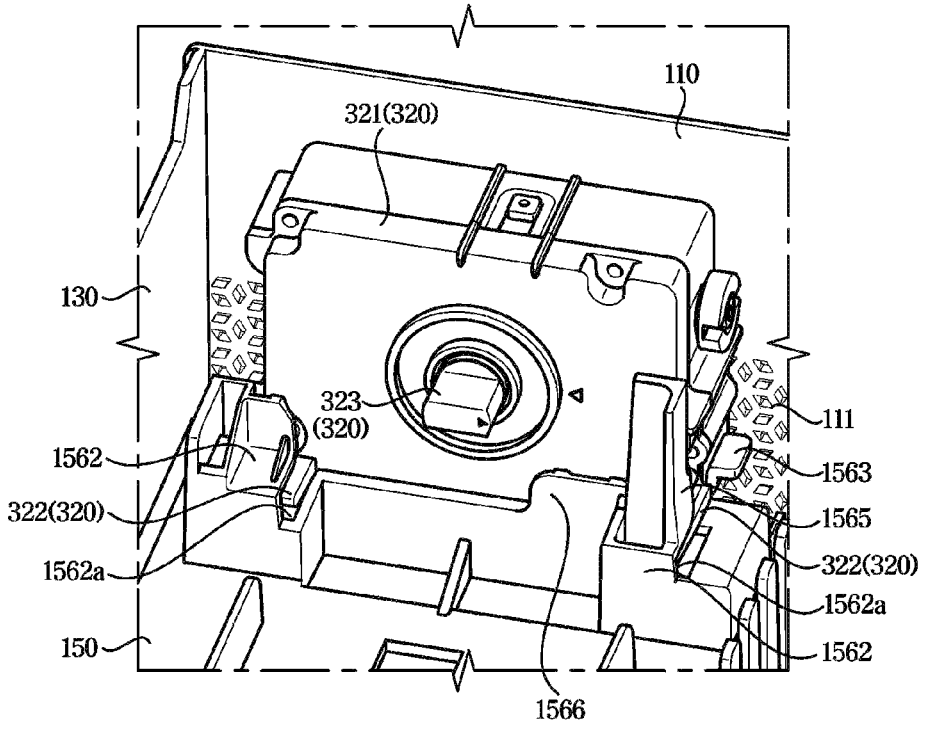
FIG. 11 is a view illustrating a state in which a second motor is mounted in an ice-making housing of FIG. 10 according to an embodiment of the disclosure.

FIG. 11 is a view illustrating a state in which a second motor is mounted in an ice-making housing of FIG. 10 according to an embodiment of the disclosure.

A structure of the ice-making housing 100 will be described with reference to FIGS. 6 and 7.

A plurality of motor mounting frames may be formed on one surface of the ice-making housing 100. In addition, a plurality of support frames may be formed on the other surface of the ice-making housing 100.

More specifically, the plurality of motor mounting frames may be formed so that the first motor 220 of the first ice-making unit 200 and the second motor 320 of the second ice-making unit 300 are fixed into the ice-making housing 100. In addition, the plurality of support frames may be provided to rotatably support a rear side of the first rotating shaft 211 of the first tray 210 and a rear side of the second rotating shaft 311 of the second tray 310.

Specifically, the ice-making housing 100 may include the first motor mounting frame 155 and the second motor mounting frame 156. The first motor mounting frame 155 and the second motor mounting frame 156 may be formed on the upper plate 150 of the ice-making housing 100. More specifically, the first motor mounting frame 155 and the second motor mounting frame 156 may be provided to extend inward from the upper surface of the ice-making housing 100. Detailed structures of the first motor mounting frame 155 and the second motor mounting frame 156 will be described below.

The ice-making housing 100 may include a first support frame 141 provided to support the first tray 210 and a second support frame 142 provided to support the second tray 310. In addition, the ice-making housing 100 may include a connecting frame 143 provided between the first support frame 141 and the second support frame 142.

A first shaft coupling hole 1413 may be formed in the first support frame 141 to accommodate a rear end portion of the first rotating shaft 211 of the first tray 210.

In addition, the first support frame 141 may include a first boss 1415 to be coupled to the first guide cover 410 which will be described below. The first boss 1415 may extend outward from the first support frame 141.

A second shaft coupling hole 1423 may be formed in the second support frame 142 to accommodate a rear end portion of the second rotating shaft 311 of the second tray 310. Detailed structures of the first support frame 141 and the second support frame 142 will also be described below.

The ice-making housing 100 may include a first tray partition 180 and a second tray partition 190.

The first tray partition 180 may extend inward from the upper surface of the ice-making housing 100. The first tray partition 180 may be provided at a side at which a first sidewall of the ice-making housing 100 is formed. The first sidewall and a first opening 171 of the ice-making housing 100 are components which may be exposed to the user. Accordingly, the first tray partition 180 may be provided to prevent ice from escaping through the first opening 171 when the ice made in the first tray 210 is separated from the first tray 210. In addition, the first tray partition 180 may cover a part of a side portion of the first tray 210 to minimize influence of an external environment on the ice in the first tray 210.

The first tray partition 180 may include a first slit 181. The first slit 181 may be formed as a plurality of first slits 181 in the first tray partition 180. The first slits 181 may be formed by cutting the first tray partition 180 in the vertical direction. Since the first slits 181 are formed in the first tray partition 180, cold air flowing through the first opening 171 can be smoothly supplied to the first tray 210.

The second tray partition 190 may extend inward from the upper surface of the ice-making housing 100. The second tray partition 190 may be provided to divide the first tray 210 from the second tray 310. The second tray partition 190 may be provided to extend downward from the upper surface of the ice-making housing 100.

The second tray partition 190 may be provided so that ice formed in the second tray 310 is not mixed with ice in the first ice bucket 80 when the ice is separated.

The second tray partition 190 may include a second slit 191. The second slit 191 may be formed as a plurality of second slits 191 in the second tray partition 190. The second slits 191 may be formed by cutting the second tray partition 190 in the vertical direction. Since the second slits 191 are formed in the second tray partition 190, cold air between spaces in which the first tray 210 and the second tray 310 are mounted can flow smoothly.

The ice-making housing 100 may include a first guide rib 157 and a second guide rib 158.

The first guide rib 157 may extend inward from the upper surface of the ice-making housing 100. The first guide rib 157 may be provided to guide a mounting position of the first tray 210. The first guide rib 157 may be provided as a pair of first guide ribs 157 at positions corresponding to side surfaces of the first tray 210.

A first tray mounting part 157*a* may be provided between the pair of first guide ribs 157.

The second guide rib 158 may extend inward from the upper surface of the ice-making housing 100. The second guide rib 158 may be provided to guide a mounting position of the second tray 310. The second guide rib 158 may be provided as a pair of second guide ribs 158 at positions corresponding to side surfaces of the second tray 310.

A second tray mounting part 158*a* may be provided between the pair of second guide ribs 158.

In addition, the first guide rib 157 and the second guide rib 158 may have different heights. Accordingly, the first tray 210 and the second tray 310 formed to have different heights can be prevented from being switched and assembled.

The ice-making housing 100 may include a protruding rib 1565 and a side rib 157*b*.

The protruding rib 1565 and the side rib 157*b* may be used as a kind of structure to prevent wrong assembly.

The first motor coupler 212 of the first tray 210 and the second motor coupler 312 of the second tray 310 may be provided to have different shapes. In addition, a height of the side surface of the first tray 210 may be different from a height of the side surface of the second tray 310.

More specifically, the first motor coupler 212 of the first tray 210 may be provided to have a greater width than the second motor coupler 312 of the second tray 310. Accordingly, when the first tray 210 is to be assembled to the second tray mounting part 158*a* instead of the first tray mounting part 157*a*, wrong assembly can be prevented by the protruding rib 1565. More specifically, the first motor coupler 212 of the first tray 210 having a greater width than the second motor coupler 312 of the second tray 310 may be interfered with by the protruding rib 1565 extending long from the first motor mounting frame 155. Accordingly, the first tray 210 can be prevented from being erroneously disposed on the second tray mounting part 158*a*.

In addition, when the second tray 310 is to be assembled to the first tray mounting part 157*a* instead of the second tray mounting part 158*a*, wrong assembly can be prevented by the side rib 157*b*. More specifically, the first guide rib 157 may extend inward from the ice-making housing 100 to have a greater length than the second guide rib 158. In addition, the side rib 157*b* extending from the first guide rib 157 in a lateral direction may also be provided to have the same height as the first guide rib 157.

The height of the side surface of the second tray 310 may be greater than that of the first guide rib 157 and the side rib 157*b*. Accordingly, when the second tray 310 is assembled to the first tray mounting part 157*a*, the side surface of the second tray 310 may be interfered with by the first guide rib 157 and the side rib 157*b*. Accordingly, the second tray 310 can be prevented from being erroneously disposed on the first tray mounting part 157*a*.

A coupling structure in which the first motor 220 is mounted on the first motor mounting frame 155 will be described with reference to FIGS. 8 and 9.

Referring to FIG. 8, the first motor mounting frame 155 may include a first motor supporting surface 1551 and a first seating rib 1552.

The first motor supporting surface 1551 may be provided in contact with an upper surface of the first motor 220. The first motor supporting surface 1551 may be formed to be stepped from the upper surface of the ice-making housing 100.

The first seating rib 1552 may extend forward from an inner rear side of the first motor supporting surface 1551. The first seating rib 1552 may be provided as a pair of first seating ribs 1552 at the left and right of the first motor mounting frame 155. The first seating ribs 1552 may be provided so that first insertion legs 222, which will be described below, of the first motor 220 are inserted into the first seating ribs 1552. In other words, the first seating ribs 1552 may be provided to form first insertion spaces 1552*a* into which the first insertion legs 222 of the first motor 220 are inserted.

The first motor mounting frame 155 may include a first side support 1553, a first front support 1554, and a first rear support 1556.

The first side support 1553 may be formed to extend from a side portion of the first motor supporting surface 1551. The first side support 1553 may be provided to prevent a lateral movement of the first motor 220 when the first motor 220 is mounted on the first motor mounting frame 155.

The first front support 1554 may be formed to extend from a front side of the first motor supporting surface 1551. More specifically, the first front support 1554 may extend downward from the front side of the first motor supporting surface 1551. The first front support 1554 may be provided to prevent forward movement of the first motor 220 when the first motor 220 is mounted on the first motor mounting frame 155.

The first rear support 1556 may be provided to connect the first motor supporting surface 1551 and the first seating rib 1552. The first rear support 1556 may extend to be approximately parallel to the cover plate 110 of the ice-making housing 100. The first rear support 1556 may be provided to prevent rearward movement of the first motor 220 when the first motor 220 is mounted on the first motor mounting frame 155.

Referring to FIG. 9, the first insertion legs 222 of the first motor 220 may be accommodated in the first seating ribs 1552 of the first motor mounting frame 155. More specifically, the first insertion legs 222 of the first motor 220 may be inserted into the first insertion spaces 1552*a* of the first seating ribs 1552.

In this case, the first side support 1553 may cover a part of a side portion of the first motor 220 to prevent the lateral movement of the first motor 220.

The first rear support 1556 may cover a part of a rear surface of the first motor 220 to prevent the rearward movement of the first motor 220.

A coupling structure in which the second motor 320 is mounted on the second motor mounting frame 156 will be described with reference to FIGS. 10 and 11.

Referring to FIG. 10, the second motor mounting frame 156 may include a second motor supporting surface 1561 and a second seating rib 1562.

The second motor supporting surface 1561 may be provided in contact with an upper surface of the second motor 320. The second motor supporting surface 1561 may be formed to be stepped from the upper surface of the ice-making housing 100.

The second seating rib 1562 may extend forward from an inner rear side of the second motor supporting surface 1561. The second seating rib 1562 may be provided as a pair of second seating ribs 1562 at the left and right of the second motor mounting frame 156. The second seating ribs 1562 may be provided so that the second insertion legs 322, which will be described below, of the first motor 220 are inserted into the second seating ribs 1562. In other words, the second seating ribs 1562 may be provided to form second insertion spaces 1562*a* into which the second insertion legs 322 of the second motor 320 are inserted.

The second motor mounting frame 156 may include a second side support 1563, a second front support 1564, and a second rear support 1566.

The second side support 1563 may be formed to extend from a side portion of the second motor supporting surface 1561. The second side support 1563 may be provided to prevent the lateral movement of the first motor 220 when the second motor 320 is mounted on the second motor mounting frame 156.

The second front support 1564 may be formed to extend from a front side of the second motor supporting surface 1561. More specifically, the second front support 1564 may extend downward from the front side of the second motor supporting surface 1561. The second front support 1564 may be provided to prevent forward movement of the second motor 320 when the second motor 320 is mounted on the second motor mounting frame 156.

The second rear support 1566 may be provided to connect the second motor supporting surface 1561 and the second seating rib 1562. The second rear support 1566 may extend to be approximately parallel to the cover plate 110 of the ice-making housing 100. The second rear support 1566 may be provided to prevent rearward movement of the second motor 320 when the second motor 320 is mounted on the second motor mounting frame 156.

Referring to FIG. 11, the second insertion legs 322 of the second motor 320 may be accommodated in the second seating ribs 1562 of the second motor mounting frame 156. More specifically, the second insertion legs 322 of the second motor 320 may be inserted into the second insertion spaces 1562*a* of the second seating ribs 1562.

In this case, the second side support 1563 covers a part of the side surface of the second motor 320 to prevent a lateral movement of the second motor 320.

The second rear support 1566 may cover a part of a rear surface of the second motor 320 to prevent the rearward movement of the second motor 320.

Figure 12:
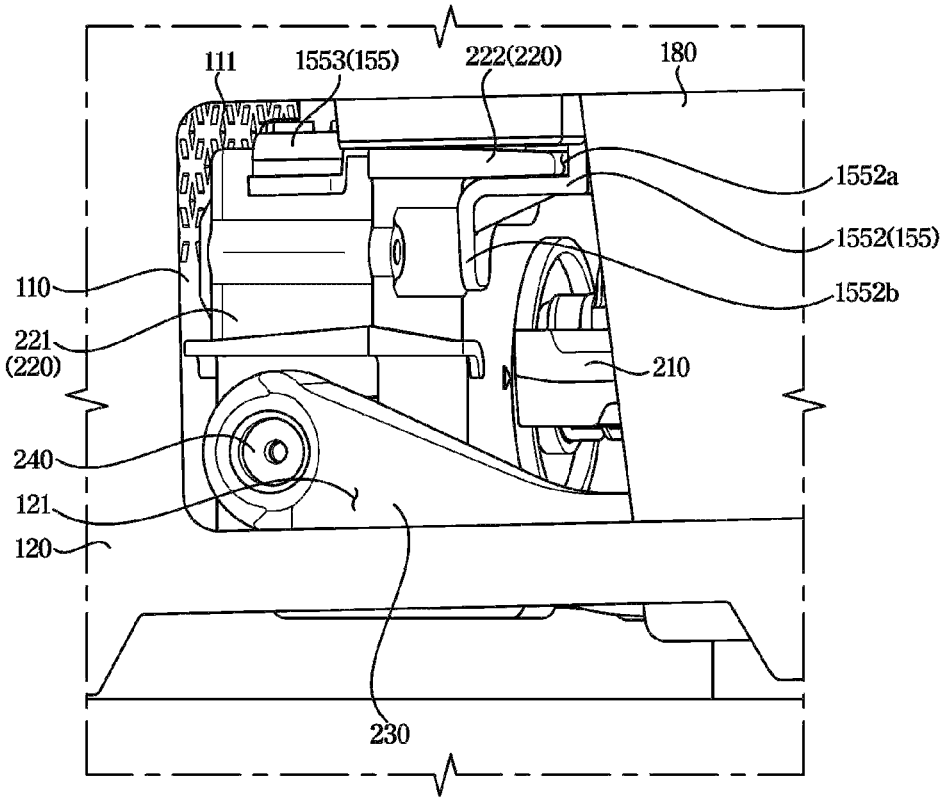
FIG. 12 is a view illustrating a state in which a first motor is mounted in an ice-making housing of a refrigerator from a first open part according to an embodiment of the disclosure.

FIG. 12 is a view illustrating a state in which a first motor is mounted in an ice-making housing of a refrigerator from a first open part according to an embodiment of the disclosure.

FIG. 12 is a view illustrating a state in which the first motor 220 is mounted on the first motor mounting frame 155 as in FIG. 9 through the first open part 121 without being turned upside down.

When the first motor 220 is mounted on the first motor mounting frame 155, the first insertion leg 222 extending rearward from the first case 221 is in a state of being inserted into the first insertion space 1552*a* of the first seating rib 1552.

Accordingly, a weight of the first motor 220 and a weight of the first full ice detection lever 230 connected to the first motor 220 may be supported by the first seating rib 1552. In addition, the first seating rib 1552 may include a first extension 1552*b* extending to be parallel to the cover plate 110. Accordingly, the first extension 1552*b* and the first rear support 1556 of FIG. 10 may support the rear surface of the first motor 220.

In addition, the first motor 220 may be connected to the first tray 210. Specifically, the first transmission part 223 illustrated in FIG. 9 may be inserted into the first motor coupler 212 of the first tray 210 illustrated in FIG. 6. Accordingly, the weight of the first motor 220 and the weight of the first full ice detection lever 230 connected to the first motor 220 may also be supported by the first tray 210. A rear end portion of the first tray 210 is supported by the support frame of the ice-making housing 100. As a result, a structure in which the ice-making housing 100 may support the entire weight of the first ice-making unit 200 can be implemented.

Referring to FIG. 12, only coupling between the first ice-making unit 200 and the ice-making housing 100*f* is illustrated, but a method of coupling the second ice-making unit 300 and the ice-making housing 100 may be provided to be the same.

Figure 13:
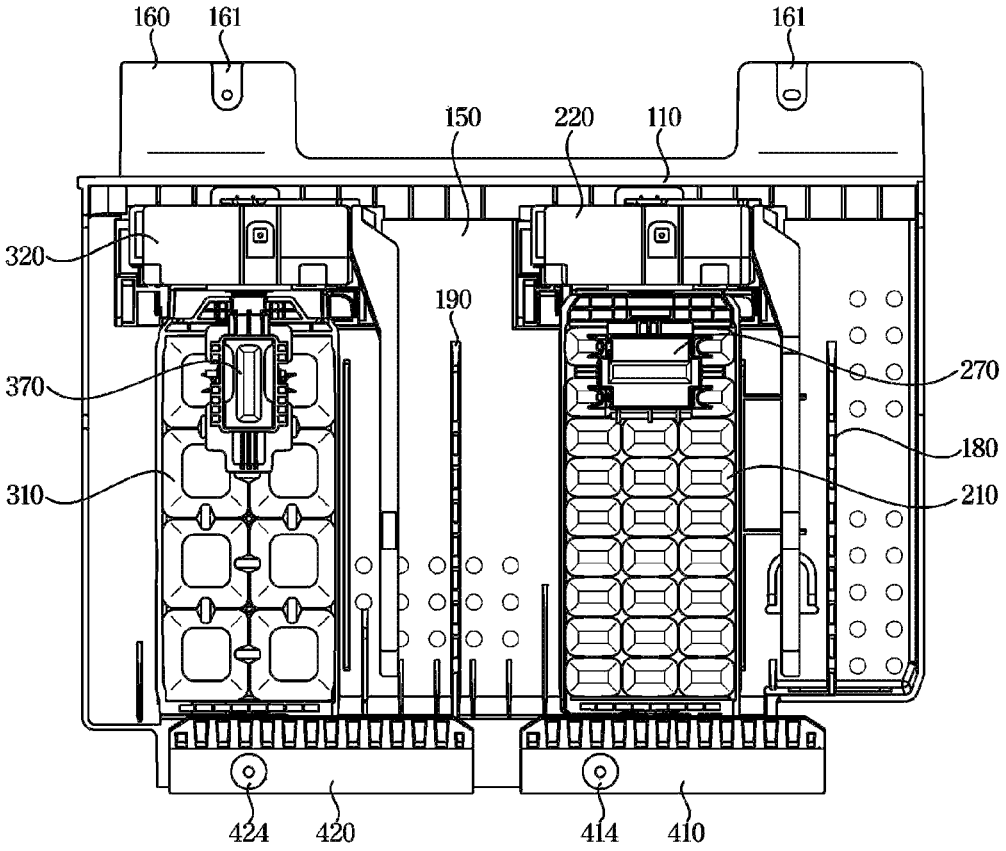
FIG. 13 is a bottom view illustrating an icemaker of FIG. 4 according to an embodiment of the disclosure.

FIG. 13 is a bottom view illustrating an icemaker 1000 of FIG. 4 according to an embodiment of the disclosure.

Figure 14:
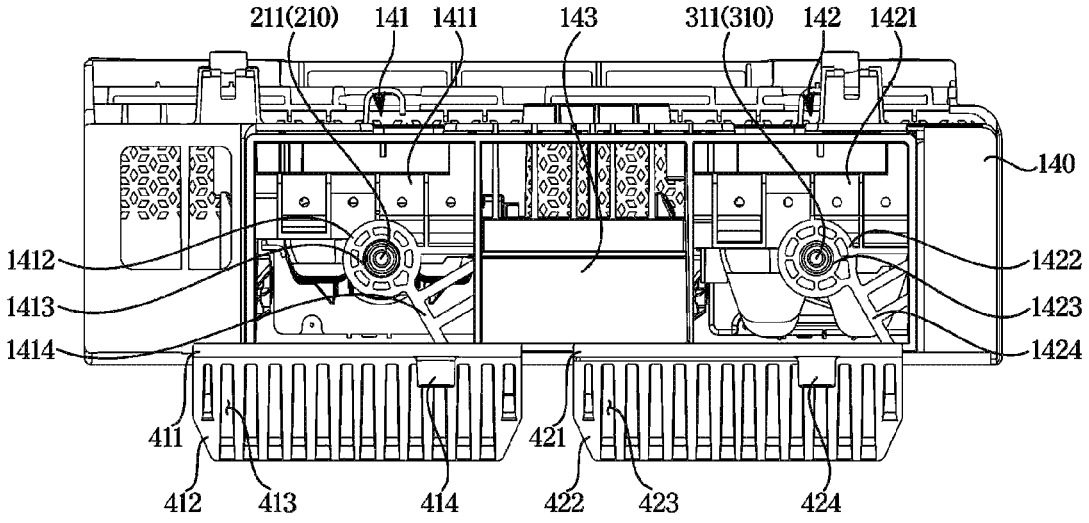
FIG. 14 is a rear view illustrating an icemaker of FIG. 4 according to an embodiment of the disclosure.

FIG. 14 is a rear view illustrating an icemaker 1000 of FIG. 4 according to an embodiment of the disclosure.

Figure 15:
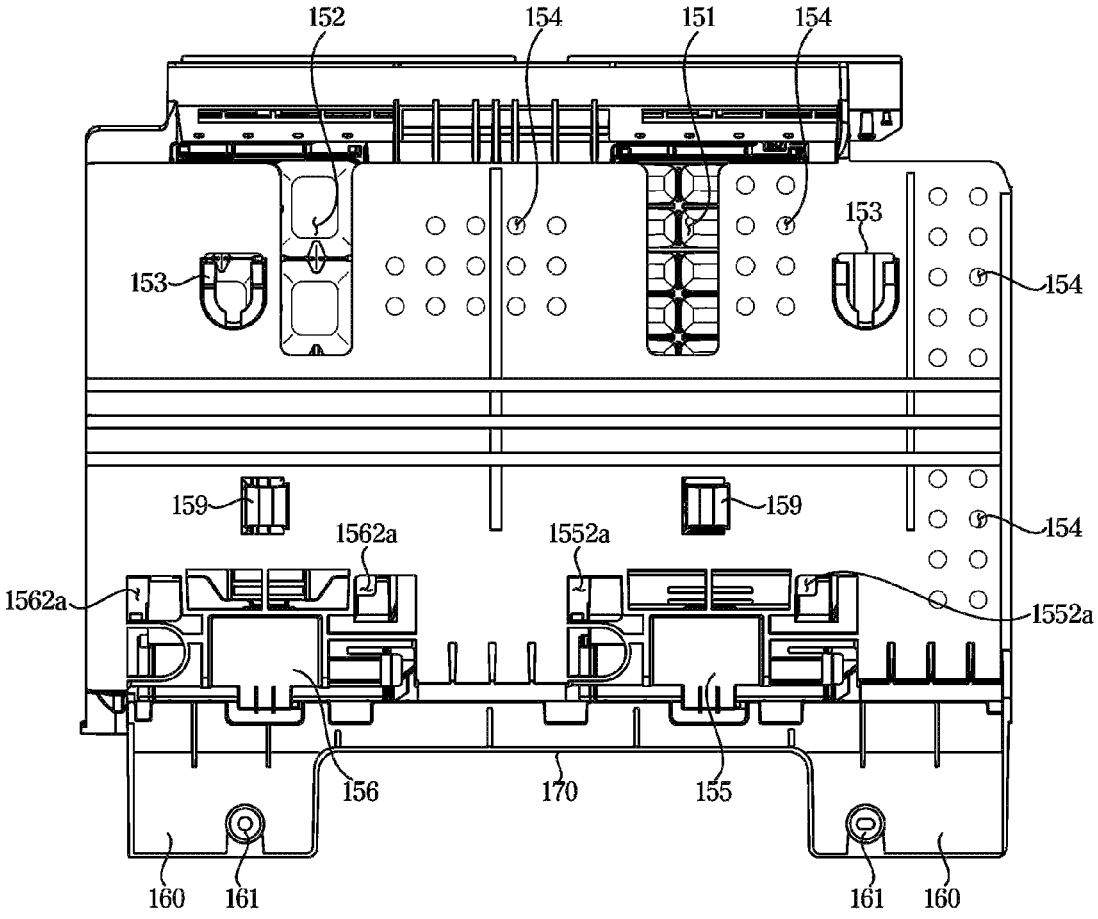
FIG. 15 is a top view illustrating an icemaker of FIG. 4 according to an embodiment of the disclosure.

FIG. 15 is a top view illustrating an icemaker 1000 of FIG. 4 according to an embodiment of the disclosure.

Referring to FIG. 13, the first motor 220 and the first tray 210 may be connected to each other and mounted in the ice-making housing 100. The second motor 320 and the second tray 310 may also be connected to each other and mounted in the ice-making housing 100.

The first sensor case 270 for accommodating the first sensor 250 and the first insulator 260 (see FIG. 5) may be mounted on the lower portion of the first tray 210. The electric wire (not shown) may be connected to the first sensor 250 to supply the power to the first sensor 250.

In addition, behind the first tray 210, the first guide cover 410 may be mounted on the ice-making housing 100. More specifically, the first guide cover 410 may be coupled to the rear side of the ice-making housing 100 through a first fastening part 414.

The second sensor case 370 for accommodating the second sensor 350 and the second insulator 360 (see FIG. 5) may be mounted on the lower portion of the second tray 310. The electric wire (not shown) may be connected to the second sensor 350 to supply the power to the second sensor 350.

In addition, behind the second tray 310, the second guide cover 420 may be mounted on the ice-making housing 100. More specifically, the second guide cover 420 may be coupled to the rear side of the ice-making housing 100 through a second fastening part 424.

Referring to FIG. 14, the ice-making housing 100 may include the first support frame 141 and the second support frame 142 formed on the rear plate 140.

The first support frame 141 may include a first plate 1411, a first shaft coupler 1412 connected to the first plate 1411, and a first reinforcing rib 1414.

The first shaft coupler 1412 may include a first shaft coupling hole 1413 for accommodating the rear end portion of the first rotating shaft 211 of the first tray 210. In addition, the first reinforcing rib 1414 may be formed to extend from the first shaft coupler 1412 so that the first shaft coupler 1412 may be firmly supported by the rear side of the ice-making housing 100.

The second support frame 142 may include a second plate 1421, a second shaft coupler 1422 connected to the second plate 1421, and a second reinforcing rib 1424.

The second shaft coupler 1422 may include a second shaft coupling hole 1423 for accommodating the rear end portion of the second rotating shaft 311 of the second tray 310. In addition, the second reinforcing rib 1424 may be formed to extend from the second shaft coupler 1422 so that the second shaft coupler 1422 may be firmly supported by the rear side of the ice-making housing 100.

Referring to FIGS. 13 and 14, the icemaker 1000 may include the first guide cover 410 and the second guide cover 420.

The first guide cover 410 may be coupled to the first support frame 141 of the ice-making housing 100. The second guide cover 420 may be coupled to the second support frame 142 of the ice-making housing 100.

The first guide cover 410 may include a first body 411, a first cover 412, a first cover slit 413, and the first fastening part 414.

The first cover 412 may be provided to be bent from the first body 411 to cover a rear lower side of the first tray 210. The first cover 412 may include a plurality of first cover slits 413. As the first cover slits 413 are formed in the first cover 412, inflow and outflow of cold air can be smoothly performed.

The first fastening part 414 may be provided to be coupled to the first boss 1415 (see FIG. 6) of the first support frame 141.

The second guide cover 420 is also provided to have the same structure as the first guide cover 410.

The second guide cover 420 may include a second body 421, a second cover 422, a second cover slit 423, and a second fastening part 424.

The second cover 422 may be bent from the second body 421 to cover a rear lower side of the second tray 310. The second cover 422 may include a plurality of second cover slits 423. As the second cover slits 423 are formed in the second cover 422, inflow and outflow of cold air can be smoothly performed.

The second fastening part 424 may be provided to be coupled to a second boss 1425 (see FIG. 6) of the second support frame 142.

A detailed structure of the upper surface of the ice-making housing 100 will be described with reference to FIG. 15.

The ice-making housing 100 may include a first water supplier 151 and a second water supplier 152 formed by cutting in the upper plate 150.

The first water supplier 151 may be provided so that the first tray 210 receives water through the first water supply apparatus 53 illustrated in FIG. 3. The second water supplier 152 may be provided so that the second tray 310 receives water through the second water supply apparatus 54.

The ice-making housing 100 may include a fixing protrusion 153.

The fixing protrusion 153 may be provided to temporarily fix a rear upper end of the ice-making housing 100 to the inner case 11. When the icemaker 1000 is mounted in the inner case 11 of the refrigerator 1, after fixing the ice-making housing 100 to the inner case 11 using the fixing protrusion 153, the icemaker 1000 may be completely coupled to the inner case 11 using the inner case coupler 161 formed in the support leg 160 of the ice-making housing 100.

The ice-making housing 100 may include the plurality of air holes 154. As described above, cold air remaining in the ice-making housing 100 may flow to the outside of the ice-making housing 100 through the plurality of air holes 154 of the ice-making housing 100. Accordingly, ice in the ice-making housing 100 can be prevented from being supercooled and frosted.

The ice-making housing 100 may include a wire fixing part 159. Electric wires (not shown) may be connected to the ice-making housing 100 to supply power to a plurality of motors and a plurality of sensors. In this case, the electric wires may be fixed to the upper plate 150 of the ice-making housing 100 using the wire fixing part 159 of the ice-making housing 100.

In the refrigerator 1 according to an embodiment of the disclosure, since the first ice-making unit 200 and the second ice-making unit 300 are directly coupled to the ice-making housing 100, the simplified icemaker 1000 can be implemented without any additional part.

In addition, since the flowing holes 111, the air holes 154, the openings 171, the open parts 121 and 131, and the like, through which cold air may flow, are formed in various positions of the ice-making housing 100, cold air may not remain in the ice-making housing 100. Accordingly, a phenomenon in which ice in the ice-making housing 100 is supercooled and frosted can be minimized.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A refrigerator comprising:
a main body including a storage compartment; and
an icemaker provided in the storage compartment,
wherein the icemaker includes:
a first tray provided to make ice having a first size and including a first rotating shaft,
a second tray provided to make ice having a second size and including a second rotating shaft,
a first motor coupled to a front of the first rotating shaft of the first tray to rotate the first tray,
a second motor coupled to a front of the second rotating shaft of the second tray to rotate the second tray, and
an ice-making housing open at a bottom and comprising a front surface, a rear surface, two side surfaces connecting the front surface to the rear surface, and an upper surface of the icemaker in which a plurality of motor mounting frames is formed on the front surface so that the first motor and the second motor are fixed in the ice-making housing and a plurality of support frames is formed on the rear surface to support a rear of the first rotating shaft and a rear of the second rotating shaft,
wherein the ice-making housing further includes:
a cover plate defining the front surface through which a plurality of flowing holes is formed,
an upper plate defining the upper surface, and
a pair of side plates defining the two side surfaces, and
wherein the ice-making housing includes an open part formed in each of the pair of side plates so that cold air flows to an inside or an outside of the ice-making housing.

2. The refrigerator of claim 1,
wherein the plurality of motor mounting frames include:
a first motor mounting frame on which the first motor is mounted, and
a second motor mounting frame on which the second motor is mounted, and
wherein the first motor mounting frame includes:
a motor supporting surface provided in contact with an upper surface of the first motor, and
a seating rib extending forward from an inner rear of the motor supporting surface so that a part of the first motor is inserted into the seating rib.

3. The refrigerator of claim 2, wherein the first motor includes:
a case, and
an insertion leg extending rearward from the case to be inserted into an insertion space formed by the seating rib of the first motor mounting frame.

4. The refrigerator of claim 3, wherein the first motor further includes:
first transmission part extending through the case to connect to a first motor coupler of the first tray.

5. The refrigerator of claim 2, wherein the first motor mounting frame includes a front support extending downward from the motor supporting surface at a front of the seating rib to prevent forward movement of the first motor.

6. The refrigerator of claim 1,
wherein the plurality of support frames include:
a first support frame provided to support the first tray, and
a second support frame provided to support the second tray, and
wherein the first support frame includes a shaft coupler in which a shaft coupling hole for accommodating a rear end portion of the first rotating shaft of the first tray is formed.

7. The refrigerator of claim 1,
wherein the upper plate of the ice-making housing is disposed to be spaced apart from an inner case, and
wherein the ice-making housing further includes a plurality of air holes formed in the upper plate.

8. The refrigerator of claim 7, wherein the ice-making housing further includes:
a pair of support legs extending upward and forward from the ice-making housing to be coupled to the inner case, and
an extension rib provided between the pair of support legs.

9. The refrigerator of claim 8, wherein the extension rib includes an opening provided by cutting a part of the extension rib between the inner case and the upper plate so that cold air flows forward or rearward from the extension rib.

10. The refrigerator of claim 9, wherein the opening is provided at a higher level than the plurality of flowing holes.

11. The refrigerator of claim 1, wherein the icemaker further includes a guide cover coupled to the plurality of support frames so that ice separated from the first tray and the second tray does not escape rearward.

12. The refrigerator of claim 1, wherein the ice-making housing includes a tray partition extending downward from an upper surface of the ice-making housing to partition between the first tray and the second tray.

13. The refrigerator of claim 1, wherein the plurality of motor mounting frames are formed on an upper plate of the ice-making housing, and wherein the plurality of support frames is formed on a rear plate of the ice-making housing.

14. The refrigerator of claim 1, wherein the ice-making housing includes:

a guide rib extending inward from an upper surface of the ice-making housing to guide a mounting position of the first tray, and a side rib extending from the guide rib in a side direction.

* * * * *